US005386634A

United States Patent [19]

Ogle et al.

[11] Patent Number: 5,386,634

[45] Date of Patent: Feb. 7, 1995

[54] MEANS FOR PREVENTING THE INTERCHANGING OF CUTTING HEAD ASSEMBLIES WITH UNSUITABLE CLIPPER BODIES AND VICE VERSA

[75] Inventors: Frank L. Ogle, McMinnville; Charles R. Baker, Spencer; Kenneth M. Campbell, McMinnville, all of Tenn.

[73] Assignee: Sunbeam Corporation, Fort Lauderdale, Fla.

[21] Appl. No.: 71,660

[22] Filed: Jun. 2, 1993

[51] Int. Cl.[6] ..... B26B 19/02

[52] U.S. Cl. ..... 30/208; 30/194

[58] Field of Search ..... 30/194, 196, 208, 210, 30/200, 216

[56] References Cited

U.S. PATENT DOCUMENTS

| | | | |
|---|---|---|---|
| 432,076 | 7/1890 | Priest | 30/196 |
| 2,014,882 | 9/1935 | Dean | 30/196 |
| 2,182,597 | 12/1939 | Oster | 30/196 |
| 2,192,054 | 2/1940 | Strezoff | 30/208 |
| 2,527,193 | 10/1950 | Meltzer | 30/196 |
| 2,542,378 | 2/1951 | Van Armbruster et al. | 30/208 |
| 2,835,970 | 5/1958 | Andis | 30/200 |
| 2,874,463 | 2/1959 | Andis | 30/200 |
| 2,892,255 | 6/1959 | Andis | 30/200 |
| 2,928,171 | 3/1960 | Oster | 30/221 |
| 3,119,942 | 1/1964 | Luther | 310/50 |
| 3,222,781 | 12/1965 | Luther et al. | 30/210 |
| 3,279,062 | 10/1966 | Andis | 30/210 |
| 3,747,594 | 7/1973 | Bishop | 30/228 |
| 4,765,060 | 8/1988 | Veselaski et al. | 30/208 |
| 4,899,444 | 2/1990 | Trichell et al. | 30/208 |
| 5,092,048 | 3/1992 | Sukow et al. | 30/210 |

*Primary Examiner*—Richard K. Seidel
*Assistant Examiner*—Hwei-Siu Payer
*Attorney, Agent, or Firm*—Michael J. Kline; Paul D. Bangor, Jr.

[57] ABSTRACT

An electric hair clipper comprising a first clipper body having a support tongue pivotally mounted on an inclined front end of the clipper body, the support tongue having an upper surface carrying a first projection and a top end defining a second open-ended slot; a first cutting head assembly releasably and operably engageable with the first clipper body, the first cutting head assembly having a tongue-receiving socket, for releasably receiving the support tongue, comprising a strap disposed on a bottom blade of the cutting head assembly, the strap having a central portion with a bottom end defining a first open-ended slot and an inner surface carrying a second projection wherein the first and second projections are received in the first and second slots, respectively, when the support tongue is inserted into the tongue-receiving socket to releasably and operably engage the first cutting head assembly with the first clipper body and also to prevent the first clipper body and the first cutting head assembly from being releasably and operably engaged with other cutting head assemblies and clipper bodies, respectively.

20 Claims, 6 Drawing Sheets

MEANS FOR PREVENTING THE INTERCHANGING OF CUTTING HEAD ASSEMBLIES WITH UNSUITABLE CLIPPER BODIES AND VICE VERSA

BACKGROUND OF THE INVENTION

1. Technical Field

The invention relates to electric hair clippers, and more particularly to the means for releasably operably attaching cutting head assemblies to the clipper bodies of electric hair clippers.

2. Related Prior Art

It is generally known to provide an electric hair clipper with a cutting head assembly which can be releasably and operably mounted on the clipper. The provision of a releasable cutting head assembly facilitates the cleaning and replacement of the cutting head assembly. Typically, an electric hair clipper for use with a releasable cutting head assembly includes a body and a spring-loaded, pivotable support tongue which is fixed to one end of the clipper body. The support tongue is engageable with the associated cutting head assembly to hold the cutting head assembly in an operable position on the clipper body. When the tongue is pivoted forwardly to an "open" position away from the body, the cutting head assembly can be placed on the tongue. When the tongue is snapped into a "closed" position against the clipper body, the cutting head assembly is held securely against the clipper body.

Two examples of releasable cutting head assemblies for use in association with a hair clipper are illustrated in U.S. Pat. Nos. 2,182,597 and 2,928,171 which issued to a predecessor-in-interest of applicant on Dec. 5, 1939 and Mar. 15, 1960, respectively. The above-listed U.S. patents illustrate cutting head assemblies which include a tongue-receiving socket for mounting the assembly on an associated support tongue.

Under some circumstances, it is undesirable for cutting head assemblies to be interchangeable between various electric clippers. One such circumstance is where the blades of the cutting head assembly, given their relative size and other physical characteristics, such as the number of cutting teeth per blade, require a specific range of horizontal (i.e., side to side) movement or "sweep" of the motor-driven lever of the clipper in order to cut efficiently.

Previously, it was known in the art to provide a clipper with a support tongue having a specific configuration which could only releasably engage a particular cutting head assembly having a correspondingly configured tongue-receiving socket, but which could not releasably engage a cutting head assembly having a differently configured tongue-receiving socket. For example, one type of support tongue known in the prior art has a relatively uniform thickness across the width of the tongue and has a generally planar bottom surface. Another type of support tongue known in the prior art has a varying thickness across the width of the tongue and is characterized by two ribs which are disposed on the bottom surface of the tongue and which extend downwardly. A cutting head assembly configured for use in association with a clipper having the first type of support tongue, i.e., a tongue having a generally planar lower surface, cannot be used interchangeably with a clipper having a support tongue including a ribbed bottom surface because the downwardly extending ribs prevent engagement of the tongue with the tongue-receiving socket.

U.S. Pat. No. 5,092,048, which issued to Sukow, et al., on Mar. 3 1992 teaches means, however, for allowing the tongue-receiving socket to be releasably engaged with various support tongues having differing configurations, i.e., having either a planar or ribbed bottom surface. Thus, the device described in the '048 patent to Sukow, et al., can provide for the combination of a cutting head assembly and a clipper body that were not designed to be used together and which results in a clipper that does not cut with optimum efficiency.

SUMMARY OF THE INVENTION

The present invention prevents the undesirable combination of a cutting head assembly and a clipper body of an electric hair clipper which were not designed to be used with one another.

One of the features of the present invention is the provision of means disposed on both the cutting head assembly and the clipper body which allow them to be releasably engaged with each other but which prevents the clipper body from releasably engaging a cutting head assembly having a tongue-receiving socket made in accordance with the prior art.

Another feature of the present invention is the provision of means disposed on both the cutting head assembly and the clipper body which allow them to be releasably engaged with each other but which prevents the cutting head assembly from being releasably engaged with a clipper body having a support tongue made in accordance with the prior art.

Yet another feature of the present invention is the provision of means disposed on both the cutting head assembly and the clipper body which allow them to be releasably engaged with each other, but which prevents both (1) the clipper body from releasably engaging a cutting head assembly having a tongue-receiving socket made in accordance with the prior art, and (2) the cutting head assembly from being releasably engaged with a clipper body having a support tongue made in accordance with the prior art.

An additional feature of the present invention is the provision of means on a replacement support tongue for use in association with a clipper body of an electric hair clipper which allows the clipper body on which it is installed to releasably engage cutting head assemblies having tongue-receiving sockets carrying one of the combinations of means according to the present invention, but which would prevent the clipper body from releasably engaging cutting head assemblies having prior art tongue-receiving sockets.

A further feature of the present invention is the provision of means disposed on a replacement strap used for defining the tongue-receiving socket of a cutting head assembly which allows the cutting head assembly to be releasably engaged with clipper bodies having support tongues having one of the various combinations of means according to the present invention, but in most instances prevents the cutting head assembly from being releasably engaged with clipper bodies having prior art support tongues.

In a first preferred embodiment, the means of the present invention comprises a first projection disposed on the upper surface of the support tongue of a clipper body and a slot for receiving the first projection defined by the bottom end of the central portion of the strap which defines the tongue-receiving socket of the cutting head assembly designed for that clipper body. The support tongue with the first projection prevents the clipper body on which it is pivotally mounted from being releasably and operably connected with cutting head assemblies having prior art tongue-receiving sockets that do not have corresponding slots for receiving the first projection. As such, the clipper body of this preferred embodiment cannot be used in association with a cutting head assembly which was not specifically designed for the clipper.

In a second preferred embodiment, the means of the present invention comprises a second projection disposed on the inner surface of the central portion of the strap which defines the tongue-receiving socket of a cutting head assembly. The invention also comprise a slot for receiving the second projection defined by the top end of the support tongue pivotally mounted on the clipper body designed to be used with the cutting head assembly. The second projection prevents the cutting head assembly of the second preferred embodiment from being used with a prior art clipper body whose support tongue does not have a corresponding slot in its top end to receive the second projection. Thus, the cutting head assembly can be used only with the clipper body for which it was specifically designed.

In a third preferred embodiment, the means of the present invention comprises a combination of the first and second preferred embodiments, wherein (1) the first projection is disposed on the upper surface of the support tongue of a clipper body of an electric hair clipper and the top end of the support tongue defines the second slot, and (2) the second projection is disposed on the inner surface of the central portion of the strap which defines the tongue-receiving socket of the cutting head assembly and the bottom end of the central portion defines the first slot. The provision of projections on both the support tongue and within the tongue-receiving socket prevents both the clipper body and cutting head assembly of the third preferred embodiment from being interchanged with devices employing prior art tongue-receiving sockets and support tongues, respectively.

In additional preferred embodiments, the means of the present invention comprises (1) a projection disposed on the upper surface of a replacement support tongue, (2) a slot defined by the top end of a different replacement support tongue, and (3) the combination of both the projection of (1) and the slot of (2) on yet a third replacement support tongue.

In yet further preferred embodiments, the means of the present invention comprise (1) a slot defined by the bottom end of the central portion of a replacement strap used to define the tongue-receiving socket of a cutting head assembly, (2) a projection disposed on the inner surface of the central portion of a second replacement strap, and (3) the combination of both the slot of (1) and the projection of (2) on yet a third replacement strap.

These and other advantages of the present invention will become more readily apparent as the following detailed description of the preferred embodiments of the present invention proceeds.

BRIEF DESCRIPTION OF THE DRAWINGS

In the accompanying drawings, the preferred embodiments of the present invention are illustrated, in which.

DESCRIPTION OF THE PREFERRED EMBODIMENTS

Figure 1:
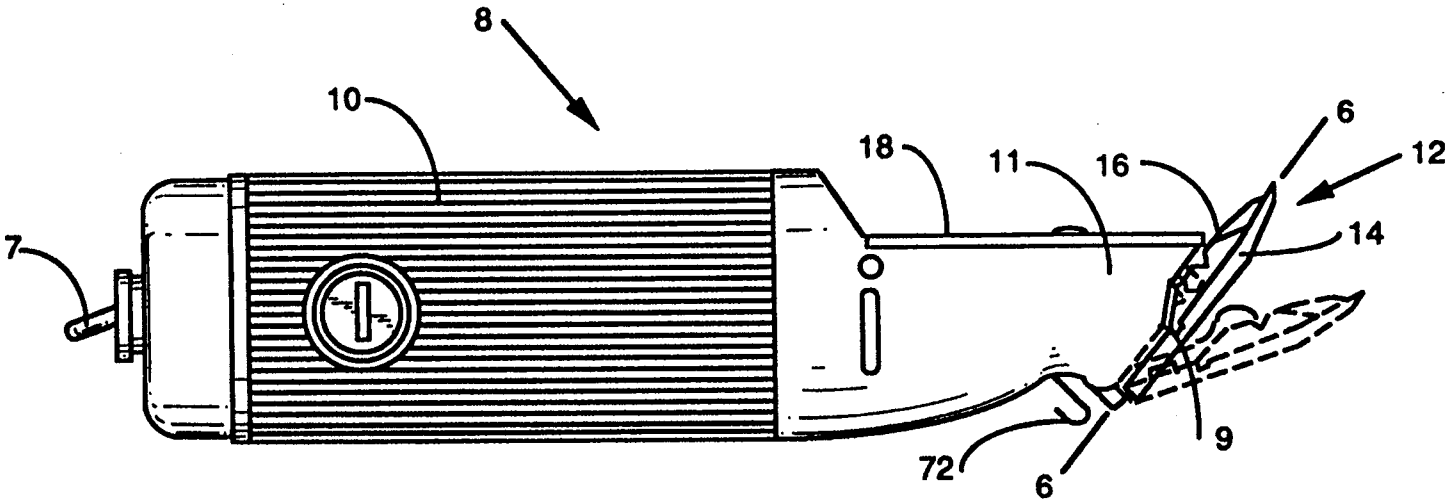
FIG. 1 is a side elevational view of a clipper and cutting head assembly on which the means of the present invention are employed.

Referring now more particularly to the accompanying drawings in which like numerals indicate like parts throughout the several views, the numeral 10 designates the body of clipper 8 which provides a housing for the motor and the driving instrumentalities (not shown) through which the motor oscillates or reciprocates a driving lever 30 which is pivotally disposed within the housing. The motor is connected to a suitable source of current which may comprise a battery disposed within clipper body 10. Alternatively, clipper body 10 could support an electric cord for connection with a suitable source of current to drive the motor. A user operable switch 7 for turning the electric motor "on" and "off" extends from clipper body 10.

Figure 3A:
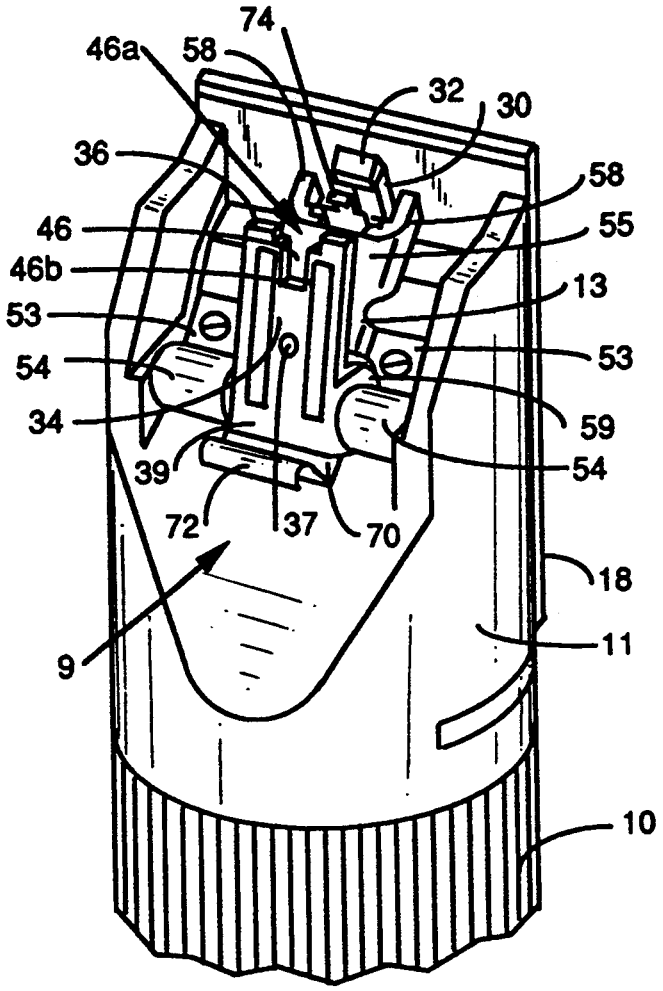
FIGS. 3A and 3B are, respectively, a front perspective view and a top plan perspective view of a clipper having means according to the present invention disposed on its support tongue for preventing the clipper from releasably engaging unsuitable cutting head assemblies.

The front end 9 of clipper body 10 is inclined as illustrated in FIGS. 1 and 3A, and the outer end 32 of driving lever 30 projects forwardly therefrom to have an operative engagement with the movable top blade 16 of the cutting head assembly, designated generally by the numeral 12.

The manner in which the motor reciprocates driving lever 30 forms no part of this invention, and therefore has not been shown. It is desired to note, however, that the transmission mechanism (such as an eccentric cam) employed for this purpose is housed within the anterior portion 11 of clipper body 10, and that this portion thereof is enclosed by a removable cover 18.

The means for removably and operably engaging the unitary cutting head assembly 12 with the clipper body 10 and for holding the same firmly in place thereon comprises interengaging parts carried by both the clipper body 10 and cutting head assembly 12. The clipper-carried part of such connecting means consists of a formed attaching plate 13 fixed to the inclined front end 9 of clipper body 10 by a pair of screws 38. The attaching plate 13 carries a pair of laterally spaced arms 53 which are curled to form a pair of hinge loops 54. A middle portion 55 of the attaching plate 13 extends outwardly from the inclined front end 9 of the clipper body 10. A pair of side flanges 58 extend upwardly from the middle portion 55 to either side of the driving lever 30. A stiff spring 70 is disposed underneath the inner surface of attaching plate 13 and lies against the inclined front end 9 of clipper body 10. Stiff spring 70 has a bottom portion 72 shaped for engagement with the bottom end 39 of a support tongue 34. The top end 74 of spring 70 is formed into a hook which projects outwardly beyond attaching plate 13.

Figure 3B:
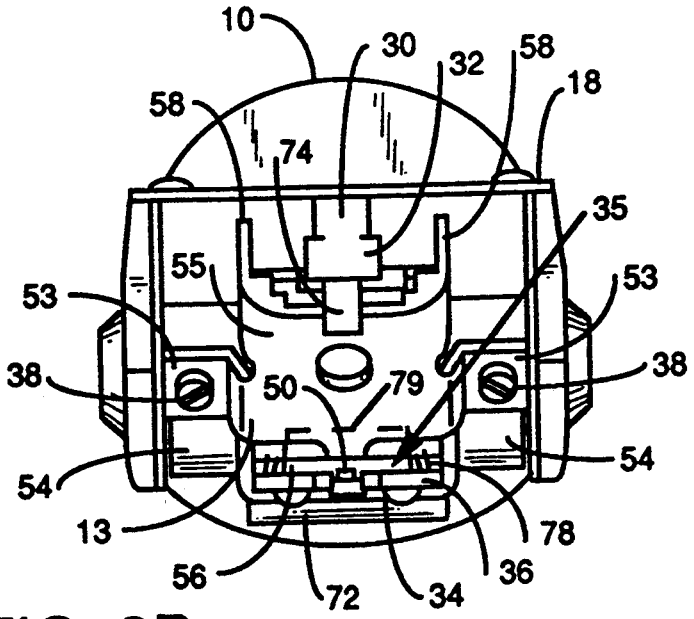
Figure 6:
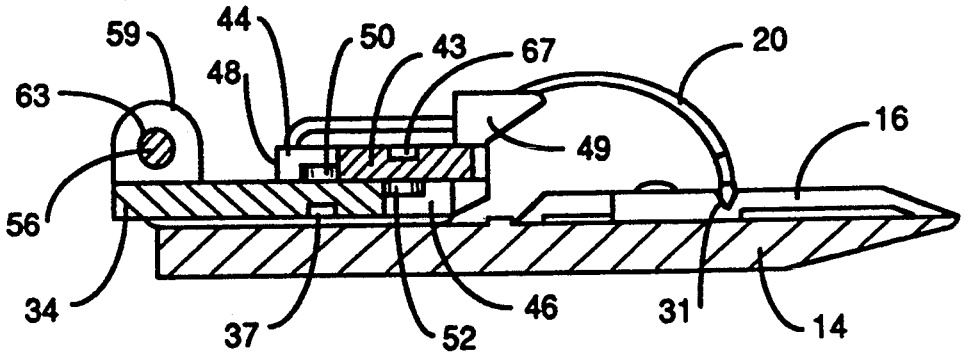
FIG. 6 is a cross-sectional view looking into the page along line 6—6 of FIG. 1 showing the means of the present invention on both the support tongue of a clipper and a cutting head assembly releasably attached thereto.

The connecting means carried by the clipper body 10 also includes the support tongue 34 which has means comprising a bracket 59 integrally formed with its bottom end 39 for enabling the support tongue 34 to be pivotally mounted on the inclined front end 9. As best shown in FIG. 6, bracket 59 has spaced-apart openings 63 for receiving hinge pin 56. As shown in FIG. 3B, the hinge pin 56 extends through both the hinge loops 54 and the spaced-apart openings in bracket 59 to hingedly mount the support tongue 34 onto the inclined front end 9 of clipper body 10. Support tongue 34 is pivotable from an "open" position wherein tongue 34 extends forwardly away from clipper body 10 (as shown in FIGS. 3A and 3B), to a "closed" position wherein tongue 34 overlies the middle portion 55 of the attaching plate 13 on the inclined front end 9 of clipper body 10. A leaf spring (not shown) is fixed to the underside of the middle portion 55 of the attaching plate 13 and engages the bracket 59 on the bottom end 39 of support tongue 34. The leaf spring holds the support tongue 34 in either the "open" or "closed" position.

Figure 7:
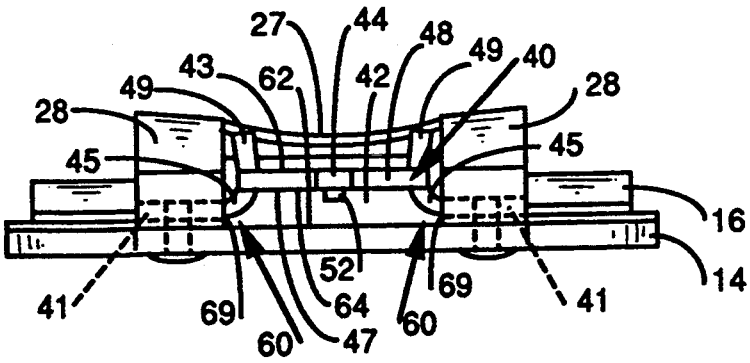
FIG. 7 is a rear elevational view of a cutting head assembly having means according to the present invention.

The part of the connecting means carried by the cutting head assembly 12 comprises a tongue-receiving socket 42 defined by a pair of spaced-apart end walls 60, a bottom wall 62 and a top wall 64, as seen in FIG. 7. A generally U-shaped strap 40, shown in FIG. 2, extends between the short inner legs 24 of spring member 20 and defines the top wall 64 of tongue-receiving socket 42. Strap 40 has a pair of spaced-apart ears 41 and a central portion 43 extending therebetween which is spaced from the upper surface 17 of base plate 15 of stationary bottom blade 14. The outer top ends of strap 40 project towards the teeth of the cutting blades and define flanges 49. Flanges 49 project up from the strap 40 and are inclined outwardly to receive therebetween the corresponding inclined side flanges 58 of the attaching plate 13.

Ordinarily, the grip between interengaging wall surfaces of the flanges 49 and 58 is sufficient to prevent outward edgewise motion of the cutting head assembly 12. To positively secure against such undesirable movement of the cutting head assembly, however, the top hooked-end 74 of stiff spring 70 engages the adjacent upper end 51 of the central portion 43 of strap 40.

In order for the top hooked-end 74 of stiff spring 70 to engage the upper end 51 of central portion 43, the bottom portion 72 of stiff spring 70 is pushed against the force of a U-shaped spring 78 towards the bottom end 39 of support tongue 34 to raise the top hooked-end 74 toward the driving lever 30. The free ends 76 of U-shaped spring 78 are wrapped around the hinge pin 56 as shown in FIG. 3B and extend inwardly towards the inclined front end 9 of clipper body 10. Free ends 76 are disposed in holes (not shown) in opposite sides of stiff spring 70 and bias the bottom portion 72 thereof downwardly away from the bottom end 39 of support tongue 34. The bottom 79 of U-shaped spring 78 is disposed around the underside of attaching plate 13 as shown in phantom in FIG. 3B. The support tongue 34 which has already been inserted into the tongue-receiving socket 42 of cutting head assembly 12 is then pivoted to its "closed" position while the bottom portion 72 is held next to the bottom end 39 of support tongue 34 against the force of spring 78. In the "closed" position, the central portion 43 of strap 40 of the cutting head assembly 12 is adjacent to the middle portion 55 of attaching plate 13. Thus, when the bottom portion 72 of stiff spring 70 is released, its top hooked-end 74 is lowered by the force of spring 78 into engagement with the upper end 51 of the central portion 43 of strap 40 and holds the cutting head assembly 12 firmly in place on clipper body 10.

To remove the cutting head assembly 12, the bottom portion 72 of stiff spring 70 is again pushed towards the bottom end 39 of support tongue 34 to raise the hooked-end 74 out of engagement with the upper end 51 of the central portion 43 of strap 40 fixed to cutting head assembly 12. The support tongue 34 can then be pivoted to the "open" position where the cutting head assembly 12 can be slid off of the support tongue 34.

Figure 2:
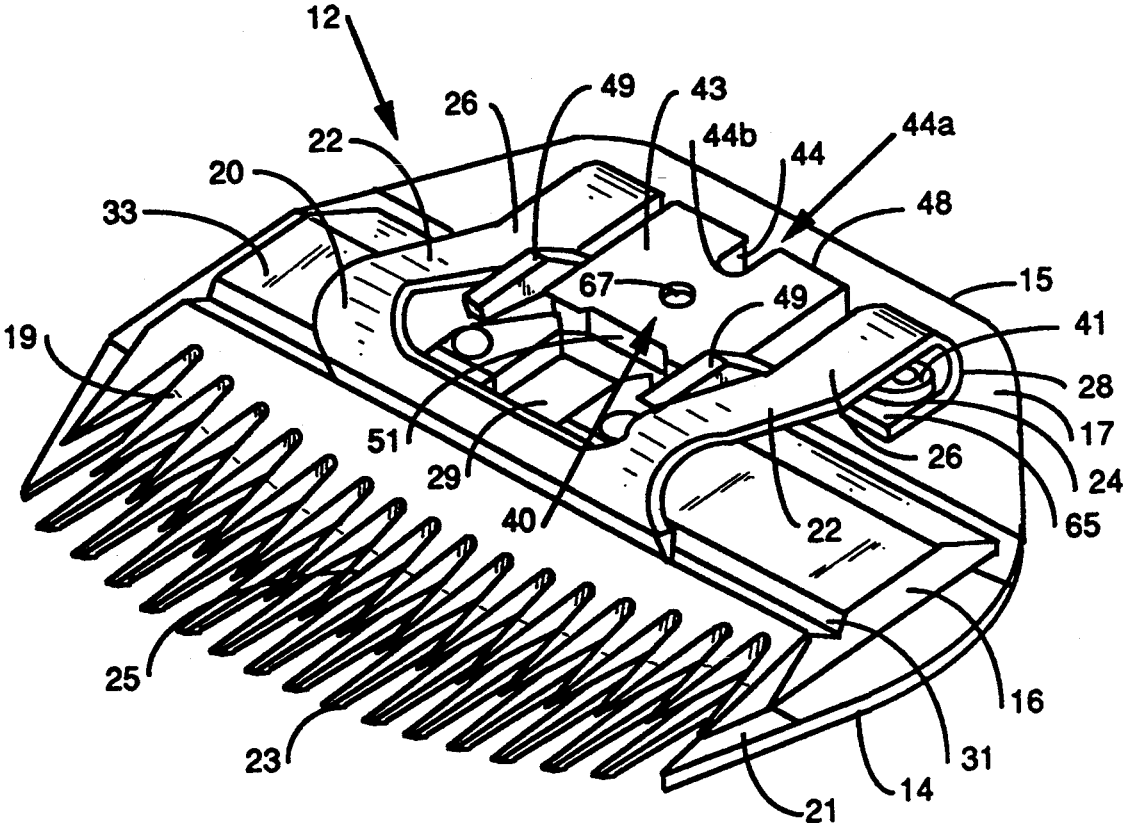
FIG. 2 is a top plan perspective view of a cutting head assembly having means according to the present invention for preventing the cutting head assembly from being releasably engaged with unsuitable electric hair clippers and vice versa.

As shown in FIG. 2, ears 41 of strap 40 are fixed to respective inner legs 24 so that the curved portions 28 of spring member 20 extend over the ears 41 of strap 40. While not shown in the drawings, strap 40 could also, for example, be fixed directly to upper surface 17 of base plate 15. As shown in FIG. 7, each of the ears 41 of strap 40 may include a bent portion 45 which curves upwardly from inner leg 24 of spring member 20 towards the central portion 43 of strap 40. In the embodiment shown in FIG. 7, bent portions 45 provide an additional clearance between upper surface 17 of base plate 15 and the inner surface 47 of central portion 43 of strap 40, which is greater than the thickness of inner legs 24. The inner sides 69 of inner legs 24 and the bent portions 45 of ears 41 thus define the spaced-apart end walls 60 of tongue-receiving socket 42.

Although not shown in the drawings, the ears 41 of strap 40 may lack bent portions and lie in the same horizontal plane as the central portion 43 of strap 40. In such case, ears 41 should be attached to the upper surfaces 65 of the inner legs 24 to provide minimal clearance between the inner surface 47 of central portion 43 and the upper surface 17 of base plate 15. In this embodiment, the inner sides 69 of inner legs 24 would alone define the spaced-apart end walls 60 of the tongue-receiving socket 42.

Referring now to FIG. 2, the cutting head assembly 12 comprises a stationary bottom blade 14 having an extended portion to provide a base plate 15 having an upper surface 17. The leading edge 21 of stationary bottom blade 14 is characterized by a set of teeth 23. Upper surface 17 of stationary bottom blade 14 supports the movable top blade 16 for reciprocal sliding movement relative thereto. Movable top blade 16 has a leading edge 19 also characterized by a set of teeth 25 which cooperate with the set of teeth 23 of stationary bottom blade 14 to cut hair when the movable top blade 16 is reciprocated relative to stationary bottom blade 14. Movable top blade 16 further defines a rearwardly opening channel 29 which is adapted to engage the outer end 32 of driving lever 30 and is reciprocally driven thereby. Outer end 32 is enlarged to afford a better connection with the rearwardly opening channel 29 of the movable top blade 16.

The cutting head assembly 12 also includes a spring member 20 which is secured to stationary bottom blade 14 and presses down upon movable top blade 16 to urge the blades flatwise against one another to maintain sufficient pressure therebetween for efficient cutting. As described more fully in U.S. Pat. No. 2,928,171 to Oster, spring member 20 comprises a pair of spaced-apart identical leaf springs 22 each doubled upon itself into a looped or substantially U-shaped formation having a short inner leg 24 which is fastened to base plate 15 of stationary bottom blade 14, a longer outer leg 26 and a curved portion 28 connecting the inner leg 24 to the outer leg 26. Each of the inner legs 24 has an upper surface 65 and an inner side 69, as seen in FIG. 7. The two leaf springs 22 are connected, at the free ends of their outer legs 26, by a cross bar 27. Preferably, the two leaf springs 22 and their connecting cross bar 27 are one integral stamping of metal or other suitable material. Cross bar 27 is received in a V-shaped channel 31 which is disposed between the set of teeth 25 and rearwardly opening channel 29 in the upper surface 33 of movable top blade 16.

In a first preferred embodiment of the present invention, clipper body 10 has the replacement support tongue 100 (see FIG. 4C) pivotally mounted on its inclined front end 9 in the same manner that support tongue 34 is mounted thereon in FIG. 3A. A projection 108 is located on the upper surface 109 of support tongue 100. Projection 108 is preferably 20 to 25 thousandths of an inch in height and may be integrally formed as a part of support tongue 100 or it may be otherwise attached to support tongue 100 by any suitable means, such as welding, stamping or soldering. The first preferred embodiment of the present invention also includes cutting head assembly 12 with replacement strap 120 of FIG. 5B fixed to the base plate 15 of its bottom blade 14 in the same manner that strap 40 is fixed thereto in FIG. 2. Referring to FIG. 5B, the bottom end 125 of the central portion 121 of replacement strap 120 defines a slot 126 having an open end 127 and a closed end 128. When the tongue-receiving socket defined by replacement strap 120 of cutting head assembly 12 of this first preferred embodiment is fit over the replacement support tongue 100 pivotally mounted on clipper body 10 to releasably mount cutting head assembly 12 thereon, the projection 108 is received in slot 126 through open end 127.

Projection 108 prevents support tongue 100 from being received in most, if not all, of the prior art cutting head assembly tongue-receiving sockets, including the tongue-receiving socket taught by the '048 patent to Sukow et al. Thus, cutting head assemblies not specifically designed for use with clipper body 10, on which replacement support tongue 100 is mounted, cannot be releasably and operably attached thereto.

Figure 4A:
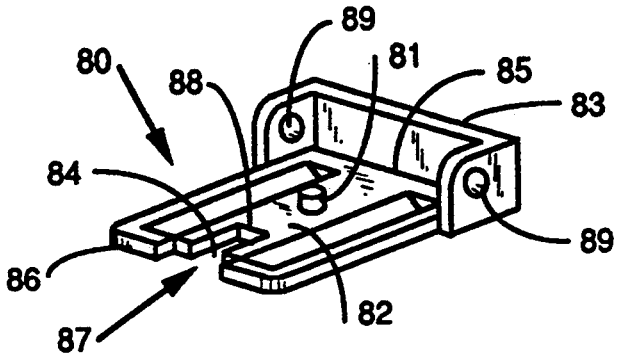
FIGS. 4A, 4B and 4C provide perspective views of replacement support tongues having several different combinations of means in accordance with the present invention.
Figure 4B:
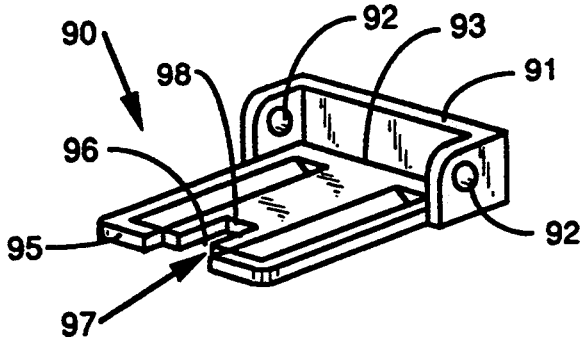

In a second preferred embodiment of the present invention, clipper body 10 has the replacement support tongue 90 of FIG. 4B pivotally mounted on its inclined front end 9 in the same manner that support tongue 34 is mounted thereon in FIG. 3A. As shown in FIG. 4B, the top end 95 of replacement support tongue 90 defines a slot 96 having an open end 97 and a closed end 98. The width of open end 97 is enlarged with respect to the width of closed end 98. The second preferred embodiment of the present invention also includes cutting head assembly 12 with replacement strap 130 of FIG. 5C fixed to the base plate 15 of its bottom blade 14 in the same manner that strap 40 is fixed thereto in FIG. 2. Referring to FIG. 5C, a projection 136 is disposed on the inner surface 137 of the central portion 131 of replacement strap 130. Projection 136 is preferably 20 to 25 thousandths of an inch in height and may be integrally formed as a part of the inner surface 137 of central portion 131 of replacement strap 130, or it may be otherwise attached thereto by any suitable means, such as welding, stamping or soldering. When the tongue-receiving socket defined by the replacement strap 130 that is fixed to cutting head assembly 12 of this second preferred embodiment is fit over replacement support tongue 90 on clipper body 10 to releasably mount cutting head assembly 12 thereon, the projection 136 is received in slot 96 through open end 97.

As is now apparent, projection 136 prevents the cutting head assembly 12 on which strap 130 is fixed, from being mounted on most, if not all, of the prior art clipper body support tongues. Thus, clippers not specifically designed for use with cutting head assembly 12, having a tongue-receiving socket defined by replacement strap 130 with projection 136 on the inner surface 137 of its central portion 131, cannot be releasably and operably engaged therewith.

In a third preferred embodiment of the present invention, the support tongue 34 pivotally mounted on the inclined front end 9 of clipper body 10, includes a first projection 50 on its upper surface 35 and a second slot 46 defined by its top end 36, as shown in FIGS. 3A and 3B. First projection 50 is preferably 20 to 25 thousandths of an inch in height and may be integrally formed as a part of support tongue 34 or it may be otherwise attached to support tongue 34 by any suitable means, such as welding or soldering. Referring to FIG. 3A, the indentation 37 in support tongue 34 illustrates that support tongue 34 may also be stamped to form first projection 50 on its upper surface 35. Second slot 46 has an open end **46*a* and a closed end 46*b*. The width of open end 46*a* is enlarged with respect to the width of closed end 46*b***.

In addition, the cutting head assembly 12 of the third preferred embodiment carries strap 40 as shown in FIGS. 2 and 7. The bottom end 48 of central portion 43 of the strap 40 of the tongue-receiving socket 42 defines a first slot 44. First slot 44 has an open end **44*a* and a closed end 44*b*. A second projection 52 is disposed on the inner surface 47 of the central portion 43 as shown in FIG. 7. Again, second projection 52 is preferably 20 to 25 thousandths of an inch in height and may be integrally formed as a part of central portion 43 or it may be otherwise attached to central portion 43 by any suitable means, such as welding or soldering. As shown by the indentation 67 in FIG. 2, the central portion 43 of strap 40 may also be stamped to form second projection 52 on its inner surface 47. As can be seen in FIG. 7, the inner surface 47 of central portion 43 opposes bottom wall 62 of tongue-receiving socket 42. Bottom wall 62 is defined by the upper surface 17 of the base plate 15 of stationary bottom blade 14**.

To releasably install cutting head assembly 12 on clipper body 10, support tongue 34 is first pivoted forwardly to its "open" position away from clipper body 10. Tongue-receiving socket 42 of cutting head assembly 12 can then be slidably placed onto support tongue 34 so that support tongue 34 is inserted into tongue-receiving socket 42. In doing so, first projection 50 on the upper surface 35 of support tongue 34 is received in the first slot 44 through its open end **44*a*. Preferably, first projection 50 is located on the centerline of support tongue 34 and first slot 44 is correspondingly located along the centerline of the central portion 43 to receive first projection 50. The present invention, however, is not limited to projections and slots located along the centerlines of support tongue 34 and central portion 43, respectively. The present invention encompasses any combination of projections and slots, including multiple projections on support tongue 34 positioned to be received within multiple slots defined by central portion 43, regardless of the particular locations of such projections and slots on the support tongue 34 and central portion 43**, respectively.

Furthermore, the second projection 52 disposed on the inner surface 47 of the central portion 43 is received in the second slot 46 through open end 46*a*. Preferably, second projection 52 is located on the centerline of the inner surface 47 of central portion 43 and second slot 46 is correspondingly located along the centerline of support tongue 34 to receive the second projection 52. The present invention, however, is again not limited to projections and slots located along the centerlines of central portion 43 and support tongue 34, respectively. The present invention encompasses any combination of projections and slots, including multiple projections on the inner surface 47 of central portion 43 positioned to be received within multiple slots defined by support tongue 34, regardless of the particular locations of the projections and slots on the central portion 43 and support tongue 34, respectively.

As can be seen, support tongue 34 having first projection 50 cannot be received in a tongue-receiving socket of a cutting head assembly which does not have a corresponding slot to receive first projection 50. Thus, clipper body 10 of the third preferred embodiment of the present invention cannot be used with cutting head assemblies that are not specifically designed for it.

Likewise, cutting head assembly 12, having tongue-receiving socket 42 with second projection 52 projecting from the inner surface 47 of the central portion 43 of its strap 40, cannot be used with a clipper body which does not have a support tongue with a corresponding slot. Thus, cutting head assembly 12 of the third preferred embodiment cannot be releasably and operably engaged with clipper bodies for which it was not specifically designed. This is important, as the degree of "sweep" provided by each type of clipper body is designed to complement the particular blade, or cutting head assembly, with which that clipper is used.

Figure 4C:
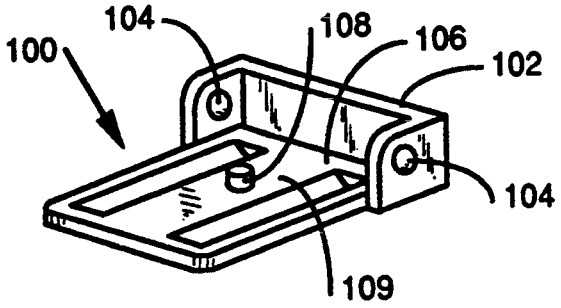

Additional preferred embodiments of the present invention are shown in FIGS. 4A–4C. Those figures illustrate replacement support tongues having three different combinations of means according to the present invention for preventing the interchanging of cutting head assemblies with unsuitable clippers and vice versa.

FIG. 4A shows a replacement support tongue 80 having a projection 81 disposed on its upper surface 82. A bracket 83, having spaced-apart holes 89, is integrally formed with the bottom end 85 of support tongue 80. The top end 86 thereof defines a slot 84 which has an open end 87 and a closed end 88. As shown in FIG. 4A, the width of open end 87 is enlarged with respect to the width of closed end 88 of slot 84. The means according to the present invention associated with replacement support tongue 80 are identical with the means disposed on the support tongue 34 in the third preferred embodiment described above. Thus, a clipper body on which replacement support tongue 80 is pivotally mounted cannot be releasably and operably engaged with a cutting head assembly whose tongue-receiving socket does not have a slot to receive projection 81. A clipper body with replacement support tongue 80, however, can be releasably and operably engaged with cutting head assemblies having tongue-receiving sockets that carry either combination of means according to the present invention of the above-described first or third preferred embodiments.

FIG. 4B shows a replacement support tongue 90 having a bracket 91, having spaced-apart holes 92, integrally formed with its bottom end 93. The top end 95 of support tongue 90 defines a slot 96 which has an open end 97 and a closed end 98. As shown in FIG. 4B, the width of open end 97 is enlarged with respect to the width of closed end 98 of slot 96. The means according to the present invention defined by replacement support tongue 90, i.e., slot 96, allow a clipper on which replacement support tongue 90 is pivotally mounted to be used with a cutting head assembly having a tongue-receiving socket which, in turn, has either combination of means according to the present invention of the above-described second or third embodiment.

FIG. 4C shows a replacement support tongue 100 having a bracket 102 having spaced-apart holes 104 integrally formed with its bottom end 106. Replacement support tongue 100 also has a projection 108 disposed on its upper surface 109. The projection 108 on upper surface 109 prevents a clipper on which replacement support tongue 100 is pivotally mounted from being used with cutting head assemblies whose tongue-receiving sockets do not define a slot to receive projection 108. A clipper with replacement support tongue 100, however, can be releasably and operably engaged with a cutting head assembly having a tongue-receiving socket such as the one described in connection with the above-described first preferred embodiment of the present invention.

Figure 5A:
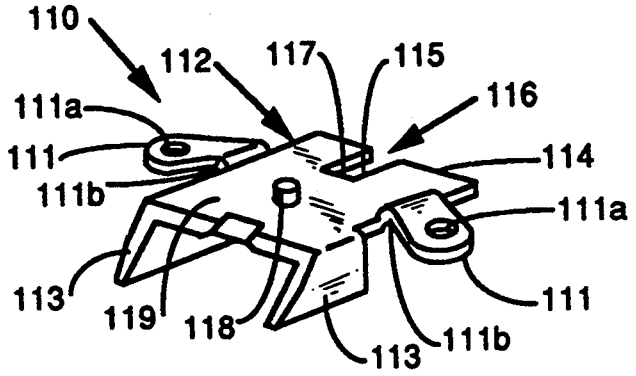
FIGS. 5A, 5B and 5C provide perspective views of replacement straps having several different combinations of means in accordance with the present invention.
Figure 5B:
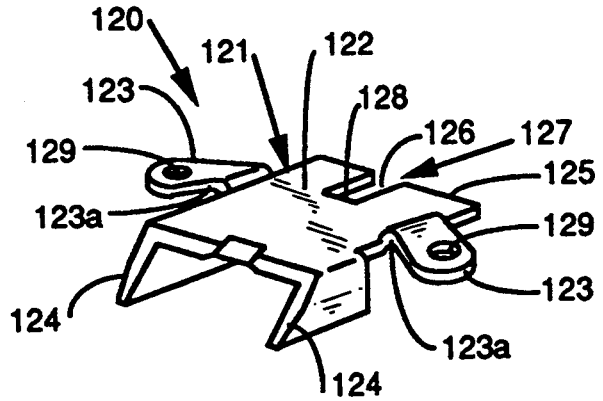
Figure 5C:
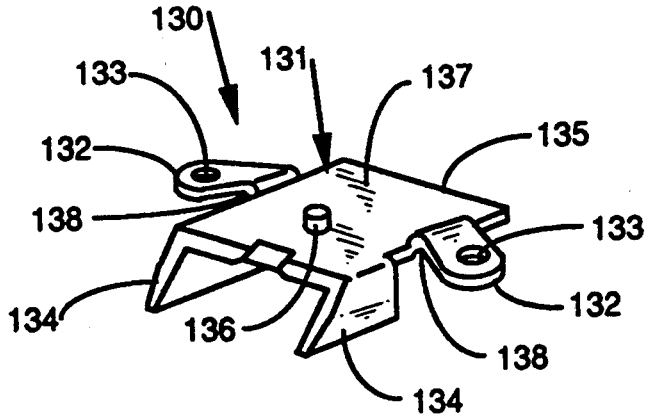

Further preferred embodiments of the present invention are shown in FIGS. 5A–5C. Those figures illustrate replacement straps which are used to define a tongue-receiving socket of a cutting head assembly. The straps of FIGS. 5A–5C show three different combinations of means according to the present invention for preventing the interchanging of cutting head assemblies with unsuitable clippers and vice versa. The replacement straps of FIGS. 5A–5C are shown in inverted positions as the inner surfaces of their central portions (which are shown facing upwardly in FIGS. 5A–5C) normally face downwardly when such straps are fixed to the bottom blade of a cutting head assembly. (See FIGS. 2 and 7).

FIG. 5A illustrates a replacement strap 110 having a generally U-shaped configuration. Strap 110 has spaced-apart ears 111 and a central portion 112 which extends between ears 111. Each ear 111 defines a hole 111*a* for receiving a screw or the like to attach strap 110 to the bottom blade 14 of cutting head assembly 12. Further, each ear 111 may include a bent portion 111*b* which curves upwardly towards central portion 112. Strap 110 also has flanges 113 which are inclined outwardly to receive therebetween the corresponding inclined side flanges 58 of attaching plate 13 of clipper 8. The bottom end 114 of central portion 112 defines a slot 115 having an open end 116 and a closed end 117. A projection 118 is disposed on the inner surface 119 of central portion 112.

As is now apparent, replacement strap 110 is identical with the version of strap 40 of the third preferred embodiment described above. A cutting head assembly carrying replacement strap 110 cannot be releasably and operably attached to a clipper having a prior art clipper body support tongue. Such cutting head assembly with replacement strap 110, however, can be releasably and operably attached to clipper bodies having support tongues identical with those in either of the above-described second or third preferred embodiments of the present invention.

FIG. 5B illustrates a replacement strap 120 which is identical with strap 110 of FIG. 5A, except that strap 120 does not have a projection on the inner surface 122 of its central portion 121. Strap 120 has spaced-apart ears 123 with central portion 121 extending therebetween. Each ear 123 defines a hole 129 for receiving a screw or the like for attaching strap 120 to the stationary bottom blade 14 of cutting head assembly 12. Furthermore, each ear 123 may include a bent portion 123*a* which curves upwardly towards central portion 121 of strap 120. Strap 120 also has flanges 124 which are inclined outwardly to receive therebetween the corresponding inclined side flanges 58 of attaching plate 13 of clipper 8. The bottom end 125 of central portion 121 defines a slot 126 having an open end 127 and a closed end 128.

Replacement strap 120 allows a cutting head assembly on which it is carried to be releasably and operably attached to a clipper body having a support tongue identical with those in either of the above-described first or third preferred embodiments. Cutting head assemblies carrying prior art straps, however, cannot be releasably and operably attached to clippers having either type of support tongue of the above-described first or third preferred embodiment of the present invention.

The strap 130 of FIG. 5C is also identical with strap 110 of FIG. 5A, except that the bottom end 135 strap 130 does not define a slot. Strap 130 has spaced-apart ears 132 with central portion 131 extending therebetween. Each ear 132 defines a hole 133 for receiving a screw or the like to attach strap 130 to the bottom blade 14 of cutting head assembly 12. In addition, each ear 132 may include a bent portion 138 that curves upwardly towards central portion 131 of strap 130. Strap 130 also has flanges 134 which are inclined outwardly to receive therebetween the corresponding inclined side flanges 58 of attaching plate 13 of clipper 8. A projection 136 is disposed on the inner surface 137 of central portion 131.

A cutting head assembly carrying replacement strap 130 cannot be releasably and operably attached to a clipper having a prior art support tongue. A cutting head assembly with replacement strap 130 can only be releasably and operably attached to a clipper body having a support tongue that is identical with the support tongue of the above-described second preferred embodiment.

While the invention has been described in detail in the foregoing for the purpose of illustration, it is to be understood that such detail is solely for that purpose and that variations can be made therein by those skilled in the art without departing from the spirit and scope of the invention as defined by the claims.

I claim:

1. An electric hair clipper comprising:

a clipper body having a support tongue pivotally mounted on a front end of said clipper body, said support tongue having an upper surface;

a first cutting head assembly releasably and operably engageable with said clipper body, said first cutting head assembly having a tongue-receiving socket for releasably receiving said support tongue, comprising a strap disposed on a bottom blade of said first cutting head assembly, said strap having a central portion with a bottom end; and means for preventing said clipper body from being releasably and operably engaged with cutting head assemblies other than said first cutting head assembly, said means comprising at least one projection disposed on said upper surface of said support tongue and at least one slot having an open end defined by said bottom end of said central portion wherein said projection is received in said slot when said support tongue is inserted into said tongue-receiving socket to releasably and operably engage said first cutting head assembly with said clipper body.

2. An electric hair clipper comprising:

a first clipper body having a support tongue pivotally mounted thereon, said support tongue having a top end;

a cutting head assembly releasably and operably engageable with said first clipper body, said cutting head assembly having a tongue-receiving socket for releasably receiving said support tongue, comprising a strap disposed on a bottom blade of said cutting head assembly, said strap having a central portion with an inner surface opposing said bottom blade; and means for preventing said cutting head assembly from being releasably and operably engaged with clipper bodies other than said first clipper body, said means comprising at least one projection disposed on said inner surface of said central portion and at least one slot having an open end defined by said top end of said support tongue wherein said projection is received in said slot when said support tongue is inserted into said tongue-receiving socket to releasably and operably engage said cutting head assembly with said first clipper body.

3. An electric hair clipper comprising:

a first clipper body having a support tongue pivotally mounted on a front end of said clipper body, said support tongue having an upper surface and a top end;

a first cutting head assembly releasably and operably engageable with said first clipper body, said first cutting head assembly having a tongue-receiving socket for releasably receiving said support tongue, comprising a strap disposed on a bottom blade of said first cutting head assembly, said strap having a central portion with a bottom end and an inner surface opposing said bottom blade; and means for preventing said first clipper body and said first cutting head assembly from being releasably and operably engaged with other cutting head assemblies and clipper bodies, respectively, said means comprising at least one first projection disposed on said upper surface of said support tongue, at least one first slot having an open end defined by said bottom end of said central portion, at least one second projection disposed on said inner surface of said central portion of said strap, and at least one second slot having an open end defined by said top end of said support tongue, wherein said first and second projections are received in said first and second slots, respectively, when said support tongue is inserted into said tongue-receiving socket to releasably and operably engage said first cutting head assembly with said first clipper body.

4. The electric hair clipper of claim 3, wherein said front end of said clipper body is inclined and said upper surface of said support tongue opposes said inclined front end of said clipper body.

5. The electric hair clipper of claim 4, wherein said support tongue is pivotally mounted on an attaching plate fixed to said inclined front end of said clipper body, said support tongue having a bottom end and said attaching plate having an underside which opposes said inclined front end of said clipper body, said underside of said attaching plate having a leaf spring fixed thereto which engages said bottom end of said support tongue for holding said support tongue in either an open position away from said inclined front end of said clipper body or a closed position adjacent said inclined front end of said clipper body.

6. In an electric hair clipper comprising a clipper body having an inclined front end;

a support tongue pivotally disposed on said inclined front end, said support tongue having an upper surface;

a cutting head assembly releasably engageable with said clipper body;

said cutting head assembly comprising a bottom blade, a top blade supported by said bottom blade, a spring member fixed to said bottom blade for biasing said top blade against said bottom blade, and a tongue-receiving socket for receiving said support tongue of said clipper body;

said spring member comprising a pair of spaced-apart leaf springs connected by a cross bar, each of said leaf springs comprising an inner leg having an upper surface and an inner side, an outer leg and a curved portion between said inner leg and said outer leg;

said tongue-receiving socket being defined by said inner sides of said inner legs, a portion of said bottom blade extending between said inner sides, and a strap, said strap having a first ear fixed to the upper surface of one of said inner legs, a central portion having a bottom end, and a second ear fixed to the upper surface of the other of said inner legs, wherein the improvement comprises a projection disposed on said upper surface of said support tongue and a slot defined by said bottom end of said central portion, said projection being received in said slot when said support tongue is inserted in said tongue-receiving socket to releasably engage said cutting head assembly with said clipper body.

7. In an electric hair clipper comprising a clipper body having an inclined front end;

a support tongue pivotally disposed on said inclined front end, said support tongue having a top end;

a cutting head assembly releasably engageable with said clipper body;

said cutting head assembly comprising a bottom blade, a top blade supported by said bottom blade, a spring member fixed to said bottom blade for biasing said top blade against said bottom blade, and a tongue-receiving socket for receiving said support tongue;

said spring member comprising a pair of spaced-apart leaf springs connected by a cross bar, each of said leaf springs comprising an inner leg having an upper surface and an inner side, an outer leg and a curved portion between said inner leg and said outer leg;

said tongue-receiving socket being defined by said inner sides of said inner legs, a portion of said bottom blade extending between said inner sides, and a strap, said strap having a first ear fixed to the upper surface of one of said inner legs, a central portion having an inner surface opposing said bottom blade, and a second ear fixed to the upper surface of the other of said inner legs; wherein the improvement comprises a projection disposed on said inner surface of said central portion and a slot defined by said top end of said support tongue, said projection being received in said slot when said support tongue is inserted in said tongue-receiving socket to releasably engage said cutting head assembly with said clipper body.

8. In an electric hair clipper comprising a clipper body having an inclined front end;

a support tongue pivotally disposed on said inclined front end, said support tongue having an upper surface and a top end;

a cutting head assembly releasably engageable with said clipper body;

said cutting head assembly comprising a bottom blade, a top blade supported by said bottom blade, a spring member fixed to said bottom blade for biasing said top blade against said bottom blade, and a tongue-receiving socket for receiving said support tongue;

said spring member comprising a pair of spaced-apart leaf springs connected by a cross bar, each of said leaf springs comprising an inner leg having an upper surface and an inner side, an outer leg and a curved portion between said inner leg and said outer leg;

said tongue-receiving socket being defined by said inner sides of said inner legs, a portion of said bottom blade extending between said inner sides, and a strap, said strap having a first ear fixed to the upper surface of one of said inner legs, a central portion having a bottom end and an inner surface opposing said bottom blade, and a second ear fixed to the upper surface of the other of said inner legs;

wherein the improvement comprises a first projection disposed on said upper surface of said support tongue, a second projection disposed on said inner surface of said central portion, a first slot defined by said bottom end of said central portion and a second slot defined by said top end of said support tongue, said first and second projections being received in said first and second slots, respectively, when said support tongue is inserted in said tongue-receiving socket to releasably engage said cutting head assembly with said clipper body.

9. An electric hair clipper comprising a releasably engageable cutting head assembly having a strap which defines a tongue-receiving socket, said strap comprising:

a pair of spaced-apart ears for attaching said strap to said cutting head assembly;

a central portion disposed between said ears, said central portion having an inner surface opposing a bottom blade of said cutting head assembly; and a projection disposed on said inner surface of said central portion, wherein said projection is received in a slot defined by a top end of a support tongue disposed on said clipper when said support tongue is inserted into said tongue-receiving socket to releasably engage said cutting head assembly with said clipper.

10. The electric hair clipper of claim 9, wherein each of said ears has a bent portion which curves upwardly towards said central portion.

11. The electric hair clipper of claim 10, wherein each of said ears is attached to one of a pair of spaced-apart legs of a spring member fixed to said bottom blade of said cutting head assembly.

12. An electric hair clipper comprising a releasably engageable cutting head assembly having a strap which defines a tongue-receiving socket, said strap comprising:

a pair of spaced-apart ears for attaching said strap to said cutting head assembly;

a central portion disposed between said ears, said central portion having a bottom end; and a slot defined by said bottom end of said central portion; wherein said slot receives a projection disposed on an upper surface of a support tongue disposed on said clipper when said support tongue is inserted into said tongue-receiving socket to releasably engage said cutting head assembly with said clipper.

13. The electric hair clipper of claim 12, wherein each of said ears has a bent portion which curves upwardly towards said central portion.

14. The electric hair clipper of claim 13, wherein each of said ears is attached to one of a pair of spaced-apart legs of a spring member fixed to a bottom blade of said cutting head assembly.

15. An electric hair clipper comprising a releasably engageable cutting head assembly having a strap which defines a tongue-receiving sockets, said strap comprising:

a pair of spaced-apart ears for attaching said strap to a bottom blade of said cutting head assembly;

a central portion disposed between said ears, said central portion having a bottom end and an inner surface opposing said bottom blade;

a first slot defined by said bottom end of said central portion; and a first projection disposed on said inner surface of said central portion;

wherein said first slot receives a second projection disposed on an upper surface of a support tongue disposed on said clipper and said first projection is received within a second slot defined by a top end of said support tongue when said support tongue is inserted into said tongue-receiving socket to releasably engage said cutting head assembly with said clipper.

16. The electric hair clipper of claim 15, wherein each of said ears has a bent portion which curves upwardly towards said central portion.

17. The electric hair clipper of claim 16, wherein each of said ears is attached to one of a pair of spaced-apart legs of a spring member fixed to said bottom blade of said cutting head assembly.

18. An electric hair clipper comprising a support tongue and a cutting head assembly having a tongue-receiving socket releasably engageable with said support tongue, said support tongue comprising:

a bottom end, said bottom end having means for enabling said support tongue to be pivotally mounted on an inclined end of said clipper for movement toward and away from said inclined end;

an upper surface opposing said inclined end; and a projection disposed on said upper surface, wherein said projection is received in a slot defined by a bottom end of a central portion of a strap defining said tongue-receiving socket when said support tongue is inserted in said tongue-receiving socket.

19. An electric hair clipper comprising a support tongue and a cutting head assembly having a tongue-receiving socket releasably engageable with said support tongue, said support tongue comprising:

a bottom end, said bottom end having means for enabling said support tongue to be pivotally mounted on an inclined end of said clipper for movement toward and away from said inclined end; and a top end defining a slot having an open end, wherein said slot receives a projection disposed on a top wall of said tongue-receiving socket when said support tongue is inserted in said tongue-receiving socket.

20. An electric hair clipper comprising a support tongue and a cutting head assembly having a tongue-receiving socket releasably engageable with said support tongue, said support tongue comprising:

a top end defining a first slot having an open end;

an upper surface; and a first projection disposed on said upper surface, wherein said first projection is received in a second slot defined by a bottom end of a central portion of a strap defining said tongue-receiving socket and said first slot receives a second projection disposed on an inner surface of said central portion when said support tongue is inserted in said tongue-receiving socket.

* * * * *